US009046821B2

(12) United States Patent
Ohmura et al.

(10) Patent No.: US 9,046,821 B2
(45) Date of Patent: Jun. 2, 2015

(54) DEVELOPMENT DEVICE AND IMAGE FORMING APPARATUS INCORPORATING SAME

(71) Applicants: Tomoya Ohmura, Kanagawa (JP); Akira Azami, Kanagawa (JP); Toshio Koike, Tokyo (JP); Masaaki Yamada, Tokyo (JP); Hiroaki Okamoto, Kanagawa (JP)

(72) Inventors: Tomoya Ohmura, Kanagawa (JP); Akira Azami, Kanagawa (JP); Toshio Koike, Tokyo (JP); Masaaki Yamada, Tokyo (JP); Hiroaki Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/059,585

(22) Filed: Oct. 22, 2013

(65) Prior Publication Data

US 2014/0112687 A1 Apr. 24, 2014

(30) Foreign Application Priority Data

Oct. 23, 2012 (JP) ..... 2012-234221
Oct. 4, 2013 (JP) ..... 2013-209660

(51) Int. Cl.
*G03G 15/08* (2006.01)

(52) U.S. Cl.
CPC ..... *G03G 15/0893* (2013.01)

(58) Field of Classification Search
CPC ..... G03G 15/0893
USPC ..... 399/273, 283, 254
See application file for complete search history.

(56) References Cited

U.S. PATENT DOCUMENTS

| | | | | |
|---|---|---|---|---|
| 4,044,719 | A * | 8/1977 | Ohmori | 299/273 |
| 2007/0264053 | A1 | 11/2007 | Iwata et al. | |
| 2010/0202805 | A1 | 8/2010 | Miyoshi et al. | |
| 2011/0008073 | A1 | 1/2011 | Kudo et al. | |
| 2011/0150525 | A1 | 6/2011 | Fujiwara et al. | |
| 2011/0217085 | A1* | 9/2011 | Hattori et al. | 399/254 |
| 2011/0311279 | A1* | 12/2011 | Okazaki et al. | 399/254 |
| 2012/0027470 | A1* | 2/2012 | Kunihiro | 399/273 |
| 2012/0051793 | A1 | 3/2012 | Kudo et al. | |
| 2012/0163874 | A1 | 6/2012 | Hattori et al. | |
| 2012/0219326 | A1 | 8/2012 | Koike et al. | |
| 2013/0034368 | A1 | 2/2013 | Hattori et al. | |

FOREIGN PATENT DOCUMENTS

| | | |
|---|---|---|
| JP | 2006-178381 | 7/2006 |
| JP | 2012-032488 | 2/2012 |

* cited by examiner

*Primary Examiner* — Sandra Brase
(74) *Attorney, Agent, or Firm* — Oblon, McClelland, Maier & Neustadt, L.L.P.

(57) ABSTRACT

A developing device to develop with two-component developer an electrostatic latent image includes a developer bearer to carry thereon developer supplied to the latent image bearer, a first conveyance channel disposed adjacent to the developer bearer, a second conveyance channel disposed adjacent to the first conveyance channel and farther from the developer bearer than the first conveyance channel, a first conveying member disposed in the first conveyance channel to agitate and transport developer supplied to the developer bearer, a second conveying member including a spiral blade winding around a shaft to transport developer in the second conveyance channel in a predetermined developer conveyance direction, and a collected-developer guide to guide a part of developer that leaves the developer bearer to the second conveyance channel beyond the first conveyance channel.

20 Claims, 12 Drawing Sheets

DEVELOPMENT DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2012-234221, filed on Oct. 23, 2012, and 2013-209660, filed on Oct. 4, 2013, in the Japan Patent Office, the entire disclosure of which is hereby incorporated by reference herein.

BACKGROUND OF THE INVENTION

1. Technical Field

The present invention generally relates to a developing device and an image forming apparatus, such as, a copier, a printer, a facsimile machine, a plotter, or a multifunction peripheral (MFP) including at least two of coping, printing, facsimile transmission, plotting, and scanning, and, more particular, to an agitation of two-component developer therein.

2. Description of the Background Art

Image forming apparatuses, such as copiers, printers, and facsimile machines, form latent images on a latent image bearer, develop the latent images by a developing device, and then transfer the developed image onto a sheet serving as a recording medium.

Latent images are developed with either one-component developer consisting essentially of magnetic or nonmagnetic toner or two-component developer consisting essentially of toner and carrier.

In the two-component developer, while being agitated, toner particles carried by carrier particles are electrically charged by friction so as to electrostatically adhere to the latent image formed on the latent image bearer such as a photoreceptor.

Development devices typically include a development sleeve and an agitation member. The development sleeve causes developer particles to magnetically stand on end on the circumferential surface thereof and carries the developer particles to the latent image bearer. The agitation member agitates the developer and supplies the agitated developer to the development sleeve. The developer is collected in the development device after the toner therein is consumed to developer the latent image.

To attain reliable toner image quality, the concentration of toner and the amount of charge are kept constant.

Since the image density decreases as the toner in developer is consumed, unused toner (i.e., virgin toner) is supplied to the developing device accordingly.

The supplied toner is agitated, mixed in developer, and thus electrically charged through friction.

To agitate two-component developer in the development device, JP-2012-32488-A proposes a configuration in which a developer chamber includes partitioned conveyance channels (i.e., first and second conveyance paths), and the developer in the conveyance channels are transported in different directions by respective developer conveying members (i.e., screw augers).

In this configuration, developer is circulated between the first conveyance path through which developer is supplied to the developer bearer and the second conveyance path in which the supplied toner is mixed in the developer. Additionally, the developer in the second conveyance path is transported to the first conveyance path.

SUMMARY OF THE INVENTION

In view of the foregoing, one embodiment of the present invention provides a developing device to develop with two-component developer an electrostatic latent image formed on a latent image bearer. The developing device includes a developer bearer to carry thereon developer supplied to the latent image bearer, a first conveyance channel disposed adjacent to the developer bearer, a second conveyance channel disposed adjacent to the first conveyance channel and farther from the developer bearer than the first conveyance channel, first and second conveying members disposed in the first and second conveyance channels, respectively, to agitate and transport developer by rotation, and a collected-developer guide to guide a part of developer that leaves the developer bearer to the second conveyance channel. From the first conveyance channel, developer is supplied to the developer bearer, and, through the second conveyance channel, developer transported from the first conveyance channel is agitated and circulated to the first conveyance channel. The second conveying member is configured to transport developer in a predetermined conveyance direction and includes a spiral blade winding around a shaft. The collected-developer guide is configured to guide the part of developer to the second conveyance channel beyond the first conveyance channel.

Another embodiment provides an image forming apparatus that includes the latent image bearer, and the developing device described above.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
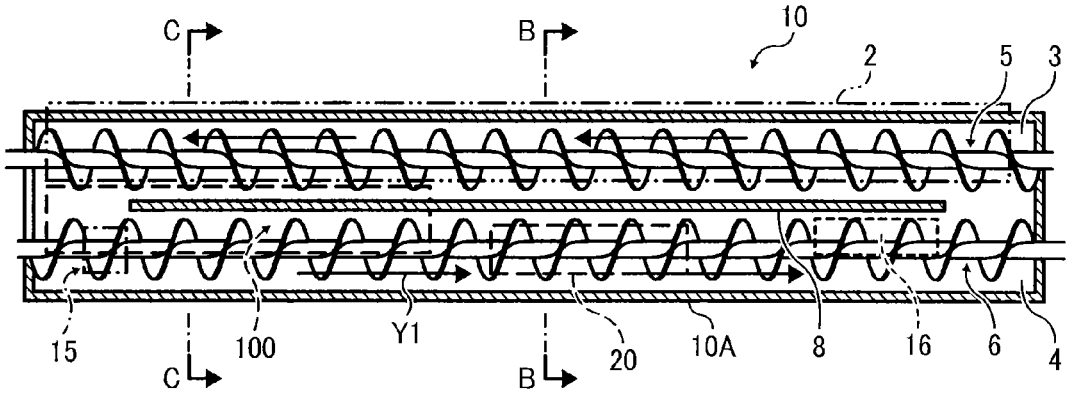
FIG. 1A is a schematic view of a developing device according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 1B:
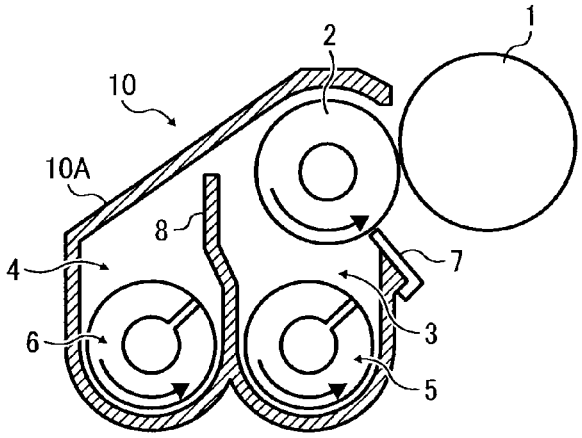
FIGS. 1B and 1C are cross-sectional views along lines B-B and C-C shown in FIG. 1A, respectively.
Figure 1C:
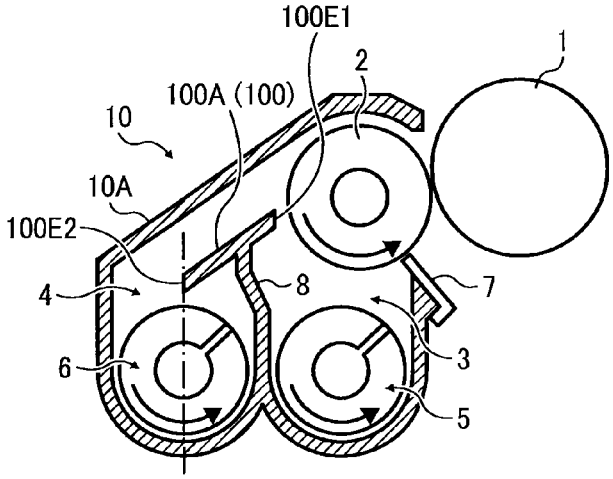

Referring now to the drawings, wherein like reference numerals designate identical or corresponding parts throughout the several views thereof, and particularly to FIGS. 1A to 1C, a developing device according to an embodiment of the present invention is described.

Embodiments of the present invention concern a collected-developer guide that can guide developer collected from a developer bearer to a second conveying member beyond a first conveying member that is closer to the developer bearer than the second conveying member. Accordingly, supplied toner accumulating in regions where movement of developer is smaller can be mixed into developer by the collected-developer thus being guided. This configuration can promote the dispersion of supplied toner into developer and enhance agitation efficiency thereof, thereby inhibiting the shortage of toner charge.

Descriptions are given below of a configuration and operation of a developing device according to the present embodiment with reference to FIGS. 1A, 1B, and 1C, which are schematic views of a developing device 10.

The developing device 10 shown in FIGS. 1A through 1C includes a casing 10A in which a developer chamber for containing two-component developer is formed. A partition 8 divides the developer chamber (i.e., an interior of the casing 10A) into a supply channel 3 (also "first conveyance channel 3"), and an agitation channel 4 (also "second conveyance channel 4").

Inside the first and second conveyance channels 3 and 4, first and second conveying screws 5 and 6, serving as first and second conveying members, are provided, respectively. Each of the first and second conveying screws 5 and 6 can agitate and convey developer. Although each of the first and second conveying screws 5 and 6 has a spiral blade or screw auger is the configuration shown in the figures, the configuration of the first conveying member is not limited thereto.

The blade of the first and second conveying screws 5 and 6 wind in the opposite directions. That is, the leading directions thereof are opposite to each other. Thus, the directions in which developer is transported in the first and second conveyance channels 3 and 4 are opposite to each other as indicated by arrows shown in FIG. 1A.

As the first and second conveying screws 5 and 6 rotate, developer including toner and carrier can be agitated and transported in the first and second conveyance channels 3 and 4.

The developer agitated in the supply channel 3 is supplied to a developer bearer 2.

The developer bearer 2 includes a sleeve, inside which magnetic poles to cause developer to stand on end and a repulsive magnetic pole are arranged. The developer supplied from the supply channel 3 is scooped and adsorbed onto the surface of the developer bearer 2 by magnetic retaining force, and thus the developer is carried thereon.

The layer thickness (i.e., amount) of developer carried on the developer bearer 2 is adjusted by a developer regulator 7, after which toner is electrostatically transferred to an electrostatic latent image formed on a photoreceptor drum 1 serving as a latent image bearer. Thus, the latent image is developed into a toner image.

The developer carried on the developer bearer 2 is collected in the agitation channel 4 when the magnetic retaining force is weakened by the repulsive magnetic pole.

The first and second conveyance channels 3 and 4 communicate with each other in end portions (i.e., communicating portions) in the developer conveyance direction where the partition 8 is absent.

The developer collected in the agitation channel 4 is agitated and transported by the conveying screw 6. The developer then moves to the supply channel 3 through the communicating portion.

Thus, developer can be circulated between the first and second conveyance channels 3 and 4. As the developer is supplied from the supply channel 3 to the developer bearer 2, the toner therein is consumed.

A supply inlet 15 is formed in the agitation channel 4 to supply toner thereto, thereby maintaining a desired concentration of toner. The supplied toner is agitated with the developer in the agitation channel 4 and charged frictionally.

The developing device 10 described above has the following features.

Since the spiral blade of the conveying screw 6 is inclined relative to a rotation axis thereof, due to the inclination, there are regions where the force to move developer (i.e., pushing force) is greater and regions where the pushing force is smaller when the spiral blade rotates.

The supplied toner is charged electrically by friction while being transported by the developer conveying members (i.e., screw augers) in the different directions in the respective conveyance channels and circulated inside the developing device.

In developing devices that employ screws as developer conveying members, developer can be transported axially, which can be advantageous in inhibiting the developer from being retained and accumulating on one side. Accordingly, it is not necessary that a supply inlet through which virgin toner is supplied extends over the entire longitudinal length of the developer chamber. Further, the developing device can be compact since the size of the conveyance channel is sufficient when the screw auger can rotate therein.

The toner supplied through the supply inlet, however, is smaller in specific gravity than the toner in the developer present in the developing device and likely to float on the surface of developer conveyed in the conveyance channel. Therefore, it is known that the chance of toner to be mixed in developer is small.

If the mixing of supplied toner in developer is insufficient, the concentration of toner in developer becomes insufficient.

This inconvenience can arise depending on the conditions of conveyance of developer by the blade of the conveying screw.

Specifically, the blade of the conveying screw is inclined relative to the rotation axis of the conveying screw. Therefore, when the blade rotates, there are regions where the force to move developer (i.e., pushing force) is greater and regions where the pushing force is smaller due to the inclination.

The supplied toner is likely to accumulate in the regions where the pushing force is smaller, and the dispersion of supplied toner using the pushing force that arises in the conveyance of developer can become insufficient.

If the mixing of supplied toner in developer is insufficient, electrical charge attained by the friction between the supplied toner and the carrier in developer is insufficient, resulting in image failure such as the scattering of toner on the background and insufficient image density.

To promote the agitation of supplied toner in developer, the developing device may further includes a developer conveyance face to guide the developer collected from the developer bearer toward the position to which the supplied toner is introduced, thereby pressing down the supplied toner by the collected developer.

If the collected developer uniformly falls to the surface of developer on the cross section of the developer conveying member, that is, if the collected developer guided to the position where the pushing force is smaller is insufficient, the supplied toner can float up due to the difference in specific gravity between the supplied toner and the developer.

Figure 14A:
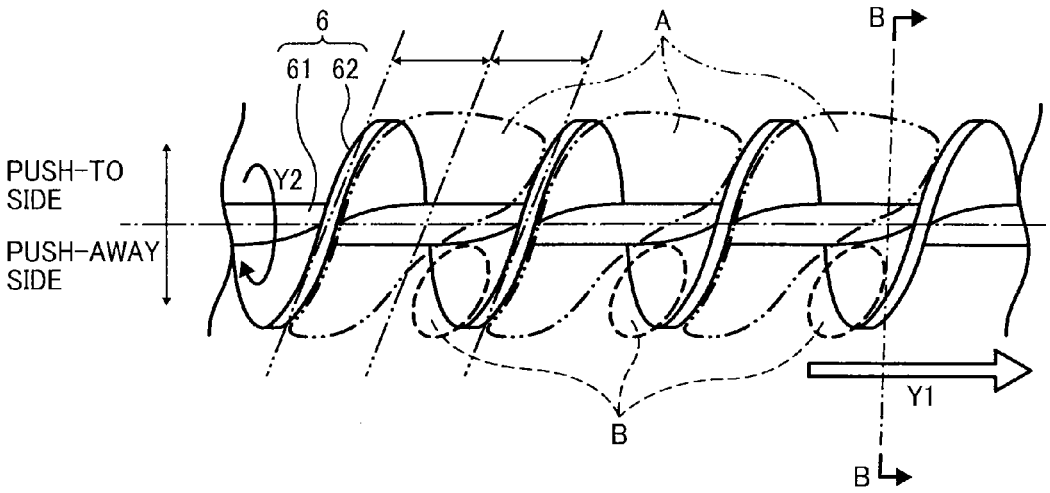
FIG. 14A is an enlarged view that illustrates the movement of developer in a partitioned developer conveyance channel in which a conveying screw is provided.
Figure 14B:
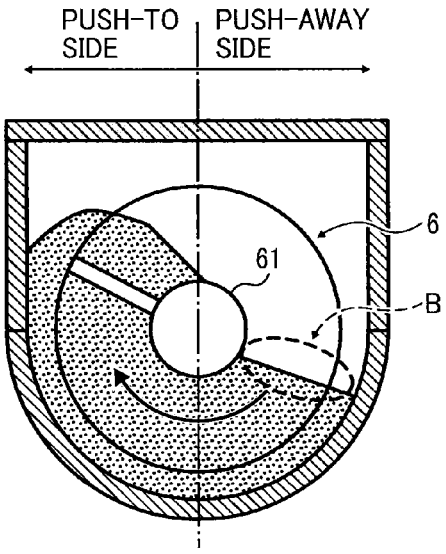
FIG. 14B is a cross-sectional view of the developer conveyance channel along line B-B shown in FIG. 14A.

FIGS. 14A and 14B illustrate a state of developer being transported by the spiral blade of the conveying screw. FIG. 14A is a view of the conveying screw 6 as viewed from above, and FIG. 14B is a view of the conveying screw 6 as viewed in a direction perpendicular to the direction of the rotation axis.

In FIGS. 14A and 14B, reference characters 61 represents the rotation shaft of the screw 6, 62 represents the spiral blade, Y1 represents the direction in which developer is transported by the conveying screw 6, and Y2 represents the direction in which the spiral blade 62 rotates.

In FIG. 14B, developer is pushed to a left-side wall and pushed away from a right-side wall as the conveying screw 6 rotates. Accordingly, for ease of understanding, relative to the vertical line passing through the center of the rotation shaft 61 of the conveying screw 6, the side on which developer is pushed to the wall is referred to as "push-to side", and the side on which developer is pushed away from the wall is referred to as "push-away side" in this specification. In other words, in FIG. 14B, the push-to side means the side on which the spiral blade 62 rotates up, and the push-away side means the side on which the spiral blade 62 rotates down.

In FIG. 14A, when the developer is transported by the rotation of the conveying screw 6, the developer accumulates on front portions of the spiral blade 62 (downstream side with reference to spiral blade 62) in the developer conveyance direction Y1 and is pushed in this state.

In push-to side regions in which developer accumulates on the front portions of the spiral blade 62 (left side regions in FIG. 14B and regions given reference character "A" in FIG. 14A), the force to push developer is stronger, and a part of the developer can override the spiral blade 62, and another part can escape in the axial direction. Thus, the movement of developer can be greater.

By contrast, on the push-away side (on the left in FIG. 14B) and on the rear side (upstream side in the developer conveyance direction Y1) of the spiral blade 62, there are regions in which the force to move developer is weaker, and the movement of developer is smaller. These regions are give reference character "B" in FIG. 14A.

When the supplied toner accumulates in the regions B, the supplied toner floats up due to the difference in specific gravity between the supplied toner and developer. Then, the supplied toner is not sufficiently mixed in the developer but is transported in this state and supplied to the developer bearer 2. Consequently, the charge of developer can be insufficient, causing image failure such as toner scattering and background smear.

A feature of the present embodiment is to forcibly mix the supplied toner, which tends to float on the surface of developer, in the developer collected from the developer bearer 2 to facilitate the dispersion of supplied toner (virgin toner) in the developer.

In particular, in the present embodiment, the collected developer is directed to the second conveying screw 6 and, in particular, directed to face of the spiral blade 62 (in FIG. 14A, rear faces, on the upstream side in the developer conveyance direction Y1) of the conveying screw 6 where the force to push developer in the developer conveyance direction Y1 is smaller. In other words, the collected developer is directed to the regions B in FIG. 14 A. With this configuration, the toner floating on the surface of developer can be forcibly mixed in the developer in the regions where the force to move developer is smaller.

The above-described feature is described in further detail with reference to FIG. 1C.

In FIG. 1C, the developing device 10 further includes a collected-developer guide 100 to direct developer from a position where the developer is collected from the developer bearer 2 toward the agitation channel 4.

The collected-developer guide 100 includes a first inclined plate 100A. Developer can move on an upper face of the first inclined plate 100A.

In FIG. 1C, the first inclined plate 100A is provided to an upper end of the partition 8 dividing the first and second conveyance channels 3 and 4 from each other. In the developer conveyance direction (indicated by arrow Y1 in FIG. 1A) in the second conveyance channel 4, the first inclined plate 100A extends from the upstream end of the partition 8 to a center (indicated by line B-B in FIG. 1A) in the longitudinal direction of the conveyance channels 3 and 4). A first end 100E1 (on "developer collecting side") of the first inclined plate 100A is positioned adjacent to the position where the magnetic retaining force exerted by the developer bearer 2 is weaker.

A second end 100E2 of the first inclined plate 100A opposite the developer collecting side is oriented to the agitation channel 4. In particular, the second end 100E2 of the first inclined plate 100A faces the regions B shown in FIGS. 14A and 14B where the movement of developer is smaller.

Thus, the first inclined plate 100A is oriented to the developer collecting side and to the regions B. The orientation of the first inclined plate 100A has an inclination with which developer can fall, that is, greater than the angle of repose of developer.

With the above-described configuration of the present embodiment, the developer collected from the developer bearer 2 can fall on the first inclined plate 100A of the collected-developer guide 100.

Subsequently, according to the orientation thereof, the developer can fall toward the regions B in the agitation channel 4 where the force of the conveying screw 6 to move developer in the developer conveyance direction is smaller. In other words, the developer can fall to the region where the level of developer is lower.

As shown in FIG. 1A, the toner supply inlet 15 is positioned above the second conveyance channel 4 and upstream from the upstream end of the partition 8 in the developer conveyance direction Y1 in the second conveyance channel 4.

The virgin toner is supplied to the agitation channel 4, after which the collected developer is introduced to the second conveyance channel 4 from the first incline plate 100A of the collected-developer guide 100 disposed above the partition 8. With this configuration, when the virgin toner flows to the regions B, the collected developer moving down on the first inclined plate 100A of the collected-developer guide 100 can push the virgin toner into the developer present in the regions B.

Accordingly, the virgin toner floating on the surface of developer due to the specific gravity difference can be disposed in the developer.

Consequently, while developer is transported, the toner can be agitated with the carrier in developer, and frictional charge is promoted. Thus, the insufficiency of toner concentration and charge amount can be resolved in the developer circulated toward the supply channel 3.

To enhance the efficiently in agitation by pushing the supplied toner into the developer in the regions B, it is preferred that the collected-developer guide 100 is disposed on the upstream side in the developer conveyance direction. With this configuration, insufficiency of toner concentration and charge amount can be resolved since the period of agitation can be longer.

Additionally, a toner concentration detector 16 (or a toner density detector) is provided in the agitation channel 4 as shown in FIG. 1A.

The toner concentration detector 16 detects the concentration of toner in developer (or density of toner in the agitation channel 4) on the downstream side in the developer conveyance direction in the agitation channel 4. According to results of the detection, toner supply is controlled.

The collected-developer guide 100 is disposed upstream from the toner concentration detector 16 in the developer conveyance direction Y1 shown in FIG. 1A.

With this arrangement, the supplied toner can be mixed in the developer before the concentration of toner therein is detected. Although the toner concentration detection is rendered defective if the supplied toner is floating, such an inconvenience can be inhibited.

It is to be noted that, although FIGS. 1A through 1C illustrate a configuration in which the first inclined plate 100A is present from the upstream end of the partition 8 to a center position (indicated by line B-B in FIG. 1A) in the developer conveyance direction of the second conveyance channel 4, that is, the first inclined plate 100A extends from the left end of the partition 8 to the position indicated by line B-B in FIG. 1A, this is one example of embodiments according to the present specification.

The embodiment shown in FIGS. 1A to 1C is configured to inhibit the amount of developer in the first conveyance channel 3 from varying between the upstream side and the downstream side to a degree that image failure arises, as described later with reference to FIG. 11. As long as this effect is attained, the position of the downstream end (right end in FIG. 1A) of the first inclined plate 100A in the developer conveyance direction Y1 in the second conveyance channel 4 (i.e., the longitudinal direction of the conveyance channels) is not limited to the center position in the longitudinal direction but can be shifted downstream or upstream from the center position.

In other words, the developing device 10 according to the present embodiment includes the collected-developer guide 100 (the first inclined plate 100A in particular) to guide a part of collected developer, which is collected from the developer bearer 2, to the second developer conveyance channel 4, and there is an area where the collected-developer guide 100 is present and another area where the collected-developer guide 100 is not present in the developer conveyance direction Y1 of the second conveyance channel 4. In particular, the area where the collected-developer guide 100 is present is closer to the supply inlet 15 through which toner is supplied to the developing device 10 than the area where the collected-developer guide 100 is not present.

Alternatively, the developing device 10 according to the present embodiment includes the collected-developer guide 10 (the first inclined plate 100A in particular) to guide a part of collected developer to the second developer conveyance channel 4, and the collected-developer guide 100 extends partly in the second conveyance channel 4 in the developer conveyance direction Y1. In particular, the area where the collected-developer guide 100 is present is upstream from the area where the collected-developer guide 100 is not present in the developer conveyance direction Y1.

Figure 2A:
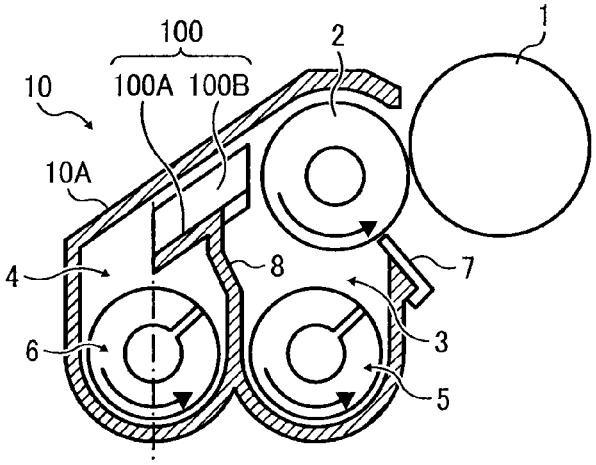
FIGS. 2A and 2B are respectively an end-on axial view and an enlarged partial view illustrating a feature of the developing device shown in FIGS. 1A to 1C.
Figure 2B:
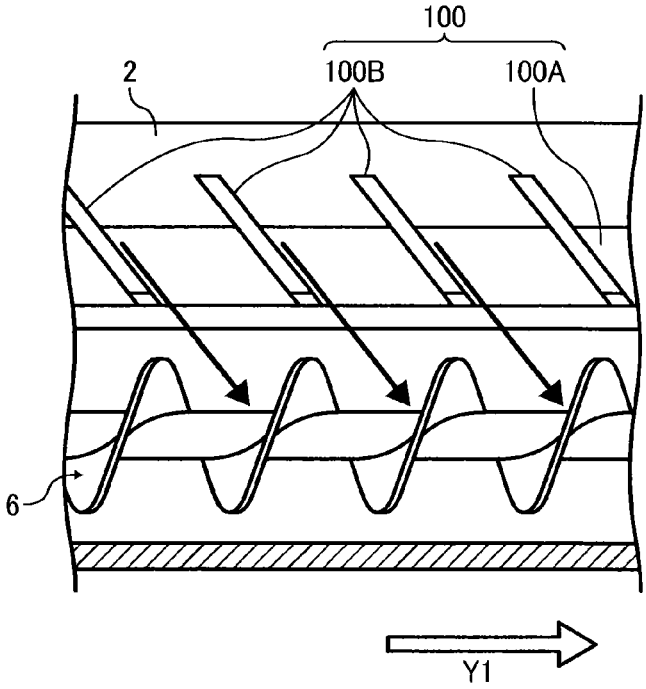

FIGS. 2A and 2B illustrate a configuration in which the collected-developer guide 100 further includes a second inclined plate 100B in addition to the first inclined plate 100A.

The second inclined plate 100B stands vertically relative to the first inclined plate 100A and inclined relative to the horizontal direction on the surface of the first inclined plate 100A. The inclination is set in a direction to increase the velocity component in the direction in which developer moves as the conveying screw 6 rotates. For example, when the end (lower end in FIG. 2B) of the second inclined plate 100B closer to the conveying screw 6 is referred to as a first end and the other end (upper end in FIG. 2B, away from the conveying screw 6) is referred to as a second end, the second inclined plate 100B is inclined such that the first end is downstream from the second end in the developer conveyance direction Y1.

In this configuration, when the developer collected from the developer bearer 2 falls to the first inclined plate 100A of the collected-developer guide 100, the direction in which the developer falls can be directed by the second inclined plate 100B in the developer conveyance direction. This configuration can increase the velocity component in the developer conveyance direction of the developer falling toward the regions B of the agitation channel 4.

With this configuration, the direction of the developer guided to the regions B in the agitation channel 4 can be determined more reliably. Accordingly, the supplied toner can be pushed down in the developer more effectively even if the supplied toner is floating.

Additionally, disposing the second inclined plates 100B at intervals identical or similar to the winding pitch of the screw blade 62 of the conveying screw 6 is advantageous.

Next, a variation is described below.

Figure 3:
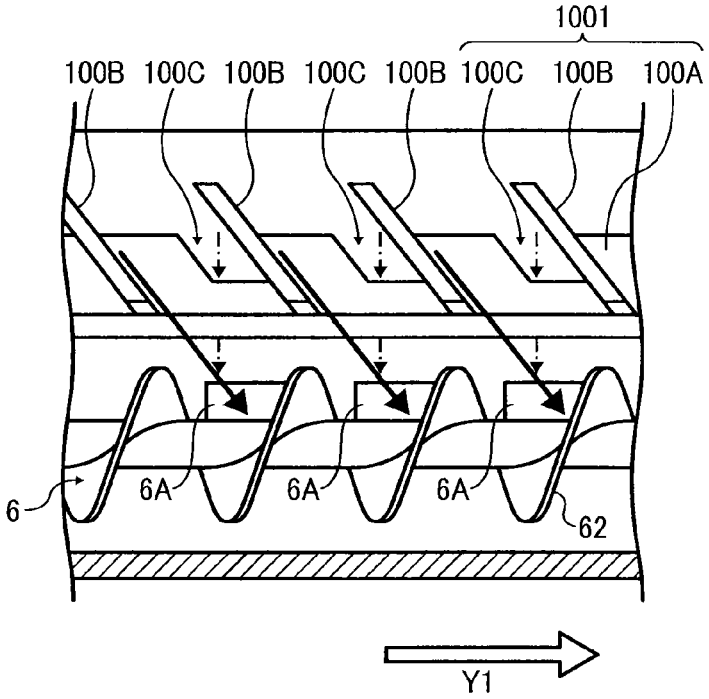
FIG. 3 is a partial diagram illustrating a variation of the feature shown in FIGS. 2A and 2B.

FIG. 3 illustrates a collected-developer guide 1001 in which at least one opening (cutout) 100C is formed to cause the collected developer to fall to the supply channel 3.

The opening 100C is formed in the collected-developer guide 100 to return a part of the collected developer to the supply channel 3. With this configuration, since a part of the collected developer can be returned to the supply channel 3, shortage of developer in the supply channel 3 can be inhibited.

If all of the developer collected from the developer bearer 2 is guided by the collected-developer guide 100 or 1001 to the agitation channel 4, the balance of developer in the supply channel 3 may be degraded. Therefore, returning a part of the developer through the opening 100C formed in the collected-developer guide 1001 is advantageous in inhibiting degradation of developer balance in the supply channel 3 and resultant image density unevenness.

Additionally, in the configuration shown in FIG. 3, the conveying screw 6 is provided with paddles 6A. For example, the paddle 6A is rectangular, extending parallel to the shaft 61 of the screw 6, and standing on the shaft 61.

The paddle 6A is aligned with the rear side of the spiral blade 62 (upstream side from the spiral blade 62) in the developer conveyance direction to correspond to the regions B described with reference to FIGS. 14A and 14B.

This configuration can efficiently mix the developer guided down by the collected-developer guide 1001 and the supplied toner floating on the surface of the developer in the regions B. That is, the developer and the supplied toner can be mixed even in regions where the spiral blade 62 is not present, thus promoting the dispersion of supplied toner in developer. Accordingly, the insufficiency of the concentration of toner and the amount of charge can be resolved.

Figure 4:
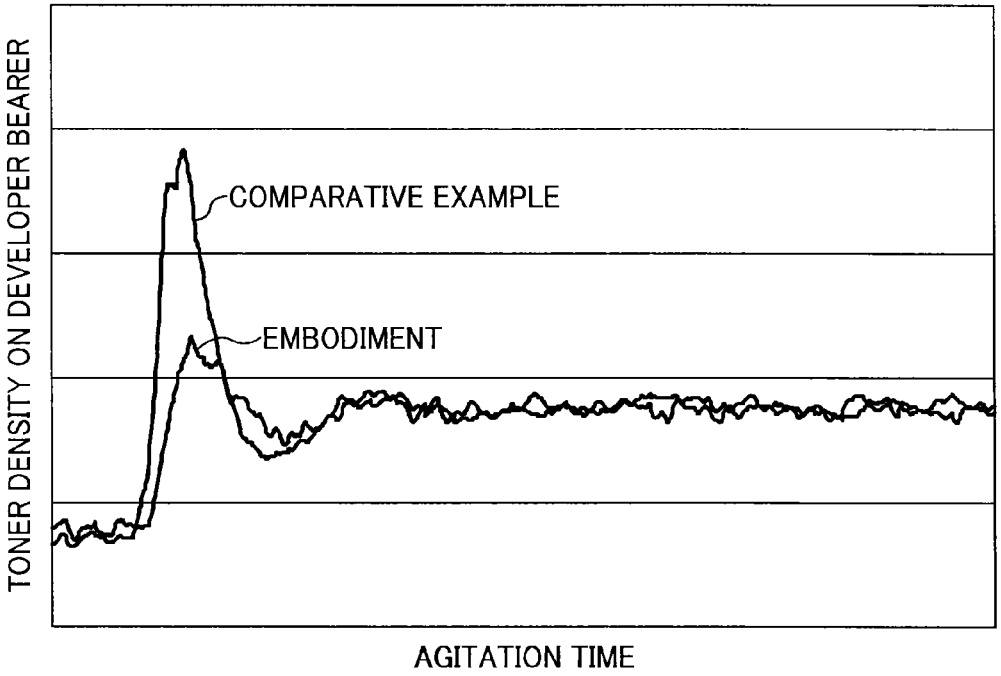
FIG. 4 is a graph illustrating characteristics of toner agitation in a configuration including a collected-developer guide according to an embodiment and a comparative example.

The agitation of toner in the above-described embodiment is compared with that in a comparative example without the collected-developer guide, and the results thereof are shown in FIG. 4.

To obtain the results shown in FIG. 4, an amount of toner greater than a standard supply amount was introduced through the toner supply inlet 15 (shown in FIG. 1A) at a time, and fluctuations over time in the concentration of toner on the upstream side in the developer conveyance direction (before toner is supplied to the developer bearer 2) were observed.

As shown in FIG. 4, in the comparative example, the supplied toner remains afloat on the surface of developer in the regions B and moves in this state. Accordingly, the density of toner on the developer bearer 2 increases abruptly when the floating toner is supplied to the developer bearer 2.

By contrast, in the present embodiment, before being supplied to the developer bearer 2, the supplied toner can be pushed into the developer present in the regions B and agitated sufficiently. Accordingly, when the developer is supplied to the developer bearer 2, the density of toner thereon does not increase abruptly.

According to the above-described embodiments, the supplied toner floating on the surface of developer can be mixed in the developer, thereby promoting the dispersion of the supplied toner in the developer. With this configuration, carrier and toner in developer can be agitated sufficiently, and the supplied toner can be frictionally charged sufficiently. As a result, the scattering of toner and the smear on the background, caused by the insufficient charge, can be inhibited.

As described above, an aspect of the present invention is to move the developer collected from the developer bearer 2 to the regions B in the agitation channel 4 (second conveyance channel), where the movement of developer is smaller. More specific configurations to achieve it are described below.

Figure 5A:
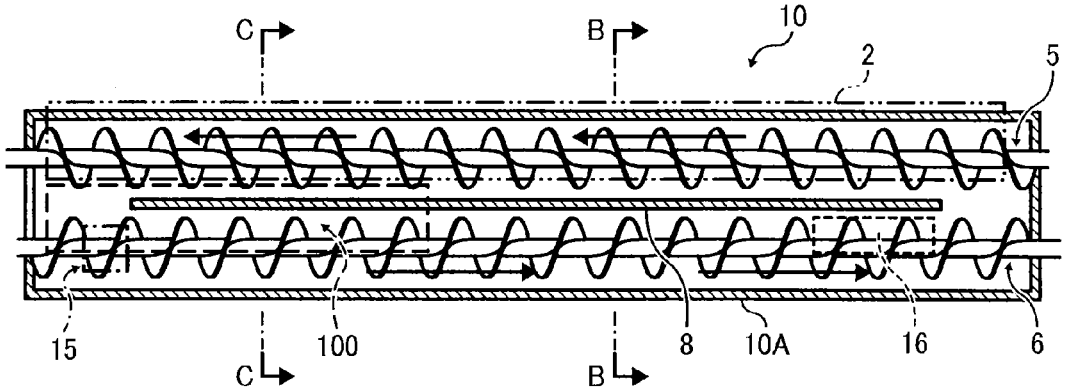
FIG. 5A is a schematic view illustrating a variation of the configuration shown in FIGS. 1A to 1C.
Figure 5B:
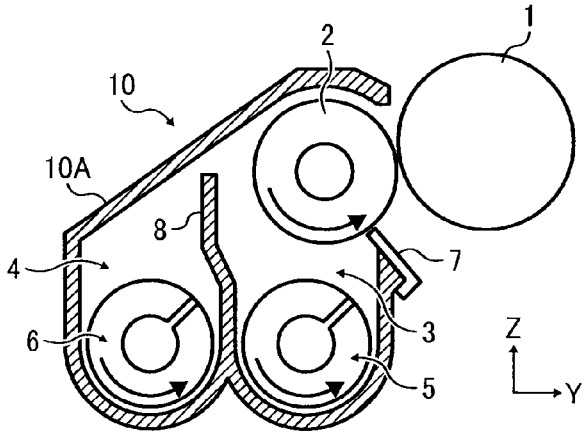
FIGS. 5B and 5C are cross-sectional views along lines B-B and C-C shown in FIG. 5A.
Figure 5C:
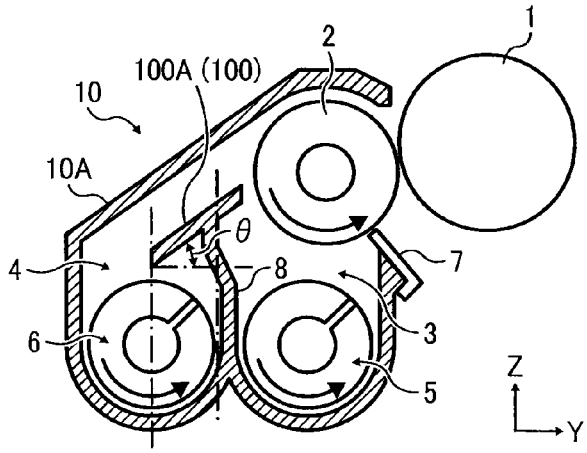

FIGS. 5A through 5C illustrate a variation of the developing device shown in FIGS. 1A through 1C. The variation has configurations similar to those shown in FIGS. 1A through 1C except the orientation (θ) of the collected-developer guide 100 described below.

FIG. 5C corresponds to the configuration shown in FIG. 1C. As shown in FIG. 5C, the first inclined plate 100A of the collected-developer guide 100 has the following configuration.

On a cross section (plane Y-Z in FIG. 5C) perpendicular to the developer conveyance direction Y1, or on a cross section as viewed from an axial end of the conveying screws 5 and 6, the first inclined plate 100A is inclined by an angle θ (hereinafter "inclination θ") relative to a horizontal direction. The inclination θ is greater than the angle of repose so that the developer can fall.

With this configuration, when the collected developer reaches the surface of the first inclined plate 100A of the collected-developer guide 100, the collected developer can slip down the first inclined plate 100A to the regions B (shown in FIGS. 14A and 14B) in the agitation channel 4. This configuration can help the developer to fall on the supplied toner afloat on the surface of the developer in the regions B, thereby facilitating the mixing of supplied toner in developer. Consequently, the carrier and the supplied toner in developer can be agitated sufficiently.

Figure 6A:
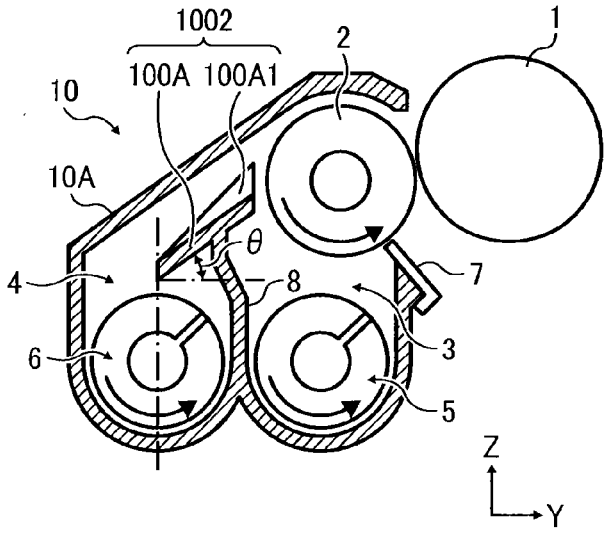
FIG. 6A is an end-on axial view illustrating a variation of the configuration shown in FIGS. 5A to 5C.
Figure 6B:
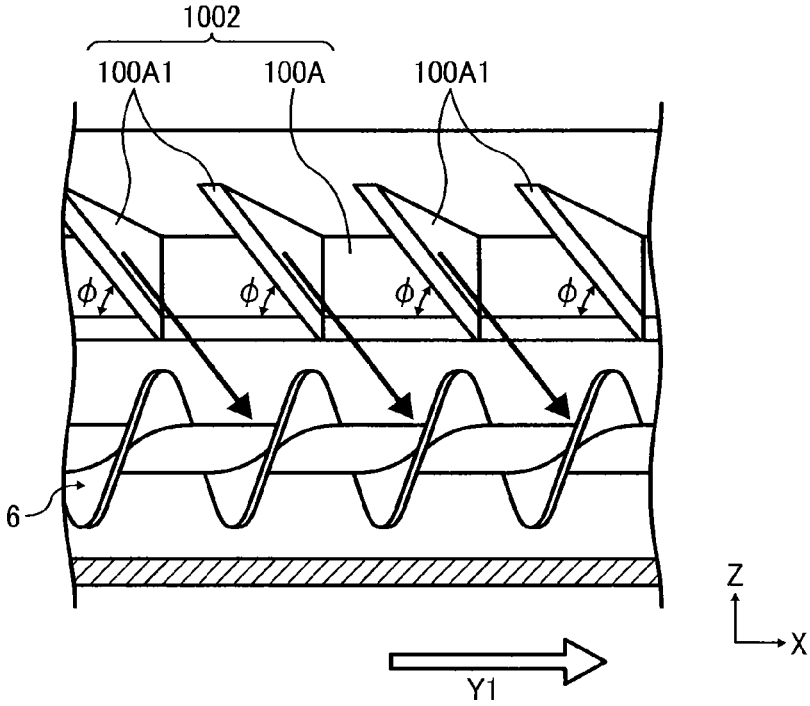
FIG. 6B is an enlarged partial view of the developing device shown in FIG. 6A.

FIGS. 6A and 6B illustrate a collected-developer guide 1002 in which the first inclined plate 100A is different from that shown in FIG. 5C.

The collected-developer guide 1002 shown in FIGS. 6A and 6B includes a slope 100A1, like a partition or screen, standing on the upper face of the first inclined plate 100A having the inclination θ.

On a cross section (plane Z-X in FIG. 6B) along the developer conveyance direction and the direction of gravity (synthesis of the two directions, or on a cross section parallel to the axial direction of the conveying screws 5 and 6, the slope 100A1 is inclined by an angle φ (hereinafter "inclination φ") relative to the horizontal direction.

Figure 7A:
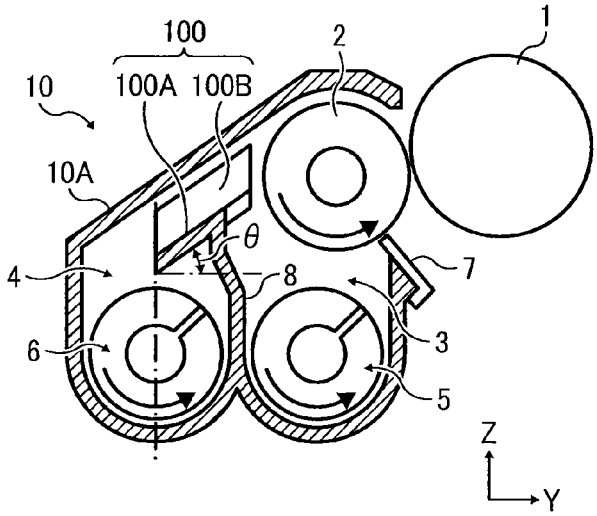
FIG. 7A is an end-on axial view illustrating another variation of the configuration shown in FIGS. 5A to 5C.
Figure 7B:
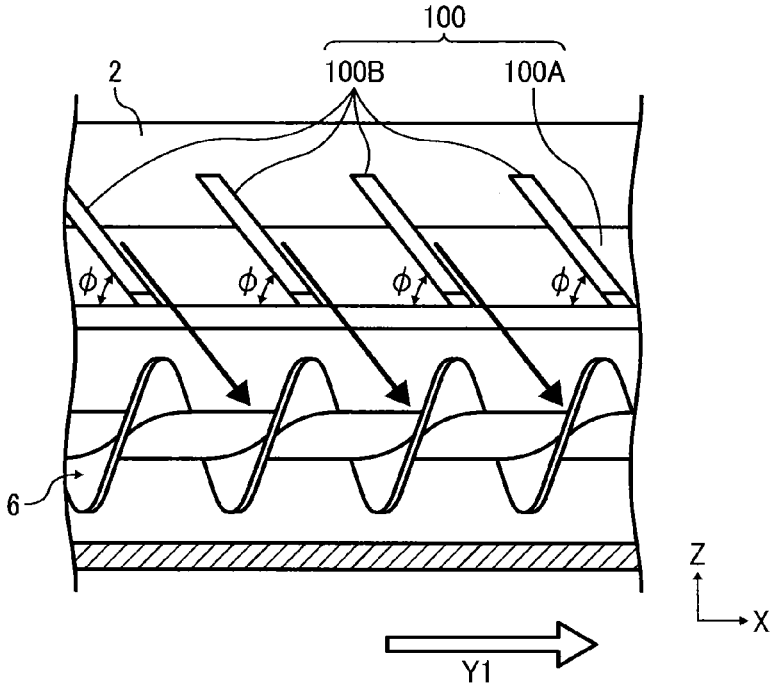
FIG. 7B is an enlarged partial view of the developing device shown in FIG. 7A.

In FIGS. 7A and 7B, the slope 100A1 shown in FIGS. 6A and 6B are formed as the second inclined plate 100B similarly to FIGS. 2A and 2B.

Similarly to the configuration shown in FIG. 5C, the second inclined plate 100B is inclined by an angle γ (i.e., inclination φ) relative to the horizontal direction on a cross section (plane Z-X in FIG. 7B) along the developer conveyance direction and the direction of gravity (synthesis of the two directions, or on a cross section parallel to the axial direction of the conveying screws 5 and 6. In the present embodiment, the inclination φ is equal to or grater than 45° and smaller than 90°. This inclination can give the velocity component in the direction in which developer is moved by the conveying screw 6 without inhibiting the developer from falling.

With the configurations shown in FIGS. 6A to 7B, when the collected developer contacts the second inclined plate 100B of the collected-developer guide 100 or 1002, the developer falls down the surface of the first inclined plate 100A while being oriented in the direction corresponding to the velocity component of the developer conveyance direction.

The developer thus falling flows to the back side of the spiral blade 62 corresponding to the regions B in the agitation channel 4.

Accordingly, the virgin toner (i.e., supplied toner) floating on the surface of developer present in the regions B can be disposed in the developer, pushed by the falling developer.

Figure 8:
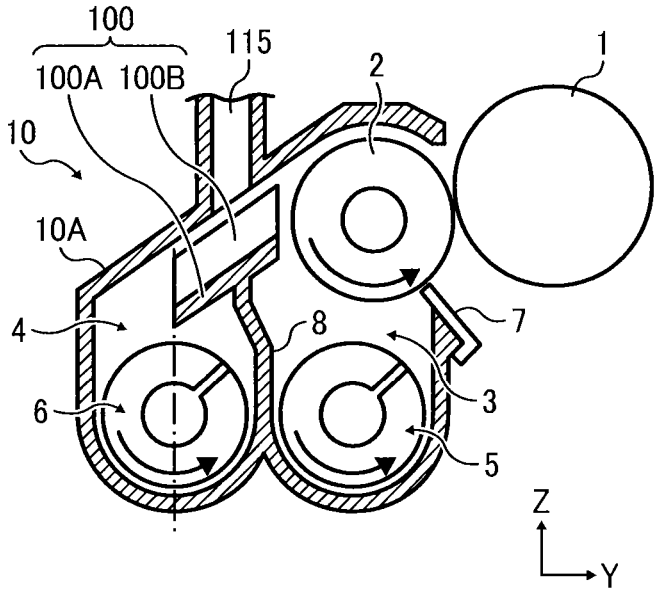
FIG. 8 is an end-on axial view illustrating another variation of the configuration shown in FIGS. 5A to 5C.

FIG. 8 is a configuration to supply toner to the agitation channel 4, applicable to the configuration shown in FIGS. 2A and 2B. In the configuration shown in FIG. 8, the position of the supply inlet 15 is different from that in FIG. 1A.

In the agitation channel 4 shown in FIG. 8, a toner supply inlet 115 is formed above the collected-developer guide 100 to supply toner to the agitation channel 4.

The position of the toner supply inlet 115 is above the collected-developer guide 100 and on the upstream side in the direction in which the developer slides down the first inclined plate 100A, that is, at the position where the collected developer falls on the first inclined plate 100A.

The toner supply inlet 115 is connected to a toner supply device. The toner supply device includes a rotatable spiral member, such as a screw and a coil without a shaft, that serves as a toner conveying member, and a pump. For example, toner is transported to the toner supply inlet together with air supplied by the pump.

When the toner transported into the agitation channel 4 from the toner supply inlet 115 falls on the first inclined plate 100A of the collected-developer guide 100, the toner is mixed with the collected developer falling on the first inclined plate 100A. Thus, the supplied toner can be mixed in the collected developer before being introduced to the agitation channel 4 (i.e., premix of supplied toner in developer).

Then, the supplied toner can electrostatically adsorb to the carrier in the developer. Even when the premix falls on the surface of developer present in the regions B in the agitation channel 4, this configuration can inhibit the supplied toner from independently floating up.

In particular, the collected-developer guide 100 shown in FIG. 8 includes, in addition to the first inclined plate 100A, the second inclined plate 100B inclined to generate the velocity component toward the developer conveyance direction.

This configuration can extend the period during which the developer moves along the second inclined plate 100B and accordingly promote the mixing effect of the supplied toner with the collected developer. Consequently, electrostatic adsorption of toner to carrier can be secured, and the supplied toner can be inhibited from floating up even when falling on the surface of developer present in the regions B.

Figure 9A:
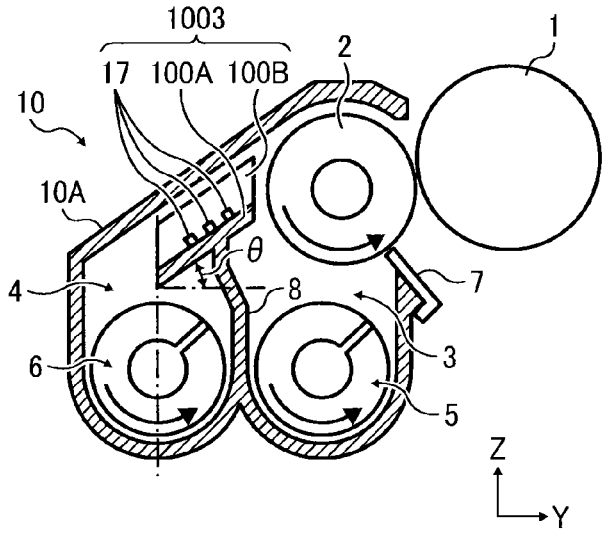
FIGS. 9A and 9B illustrate another variation of the configuration shown in FIGS. 5A to 5C.
Figure 9B:
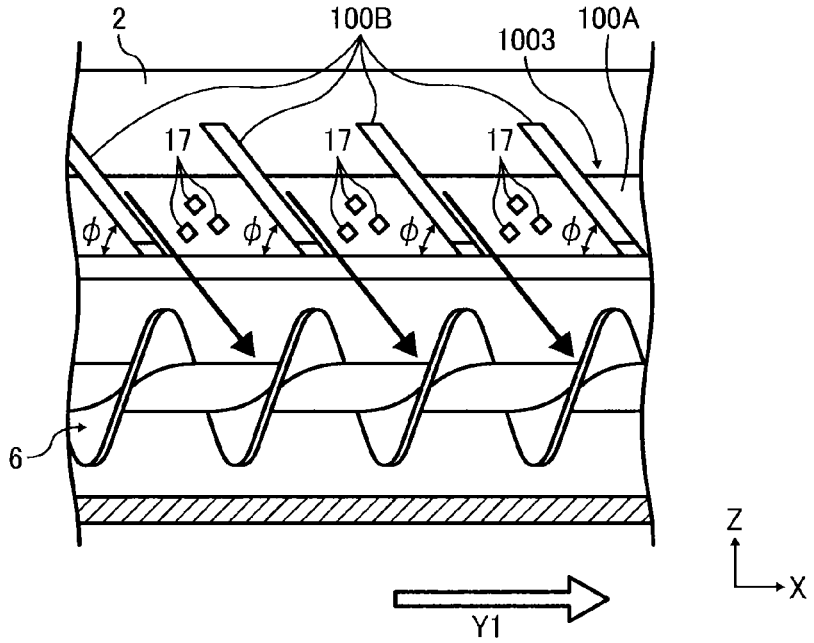

Alternatively, the configuration shown in FIGS. 9A and 9B can be used to secure the premix time of the supplied toner with the collected toner.

FIGS. 9A and 9B illustrate a collected-developer guide 1003 applicable to the configuration that includes the toner supply inlet 115 shown in FIG. 8 similarly.

The collected-developer guide 1003 shown in FIGS. 9A and 9B includes suppressors 17 disposed on the upper face of the first inclined plate 100A to suppress the falling of the collected developer and the supplied toner.

The suppressors 17 can be multiple prismatic projections fixed on the surface of the first inclined plate 100A.

The suppressors 17 are disposed to weaken the momentum of falling developer so that developer remains longer on the first inclined plate 100A than that in the case of free fall.

This configuration can extend the period during which the supplied toner and the collected developer, falling from the toner supply inlet 115, move along the first inclined plate 100A. Accordingly, the premixing time of the supplied toner with the developer can become longer.

This configuration can promote charge of carrier by friction with carrier, and the supplied toner can adsorb to the carrier in the developer sufficiently. As a result, the supplied toner falling in the regions B (shown in FIGS. 14A and 14B) of the agitation channel 4 can be mixed in the developer, being inhibited from floating up, although the supplied toner being independent tends to float up.

It is to be noted that the suppressor 17 is not limited to the prismatic one shown in FIGS. 9A and 9B. Alternatively, the suppressors 17 may be cylindrical or semicylindrical, for example.

Next, descriptions are given of a variation suitable for premixing on the collected-developer guide 100.

Figure 10:
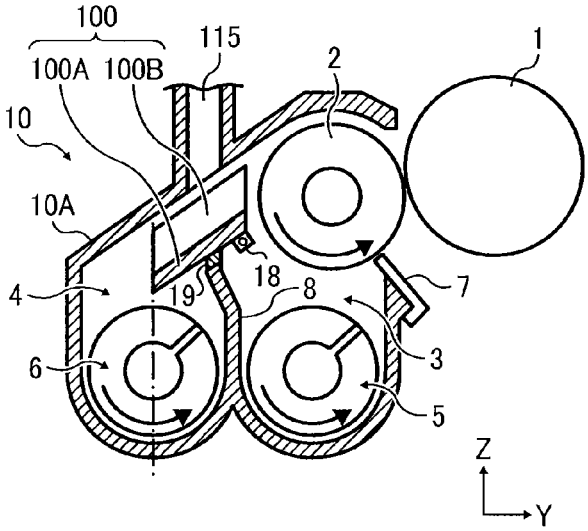
FIG. 10 is an end-on axial view illustrating another variation of the configuration shown in FIGS. 5A to 5C.

FIG. 10 illustrates a variation of the configuration shown in FIG. 2C.

In the configuration shown in FIG. 10, the collected-developer guide 100 is fixed to the upper end of the partition 8 via a vibration isolator 19.

Additionally, a vibration motor 18 is provided on the bottom of the first inclined plate 100A. With this configuration, the first inclined plate 100A can function as a planar vibrator.

This configuration can vibrate the developer sliding down the first inclined plate 100A that can vibrate when the developer is mixed with the supplied toner introduced from the toner supply inlet 115. Thus, the agitation can be facilitated. Accordingly, the frequency of contact between the carrier and the supplied toner increases, and the efficiency of frictional charging can be enhanced.

Consequently, the electrostatic adsorption of the supplied toner to the carrier in the premixing can be facilitated, and the floating of supplied toner can be inhibited when the developer falls in the regions B. This effect can compensate for the insufficiency of toner charge, which can arise when the agitation efficiency is lower due to a slow conveyance velocity in the developer conveyance channel or the like.

It is to be noted that, hereinafter "collected-developer guide 100" may mean any of the collected-developer guides 100, 1001, 1002, and 1003.

In any of the above-described configurations shown in FIGS. 1A to 2B and 5A to 10, it is assumed that the collected developer moves to the regions B when the collected developer falls on the collected-developer guide 100.

In such a configuration, it is possible that the balance of the amount of developer can be disturbed on the downstream side of the supply channel 3 in the developer conveyance direction since the developer supplied from the supply channel 3 to the developer bearer 2 then moves to the agitation channel 4.

Therefore, the configuration shown in FIG. 3 is advantageous since it can return a part of the collected developer from the collected-developer guide 100 toward the supply channel 3.

As another configuration to keep a proper balance of the amount of developer, considering the arrangement in which toner is supplied on the upstream side in the developer conveyance direction Y1 by the conveying screw 6, the collected-developer guide 100 is disposed upstream from the longitudinal center portion of the second conveyance channel 4 (indicated by line B-B in FIG. 1A) in the developer conveyance direction Y1 in the agitation channel 4.

With this arrangement, the collected developer can fall on the supplied toner at the position where the mount of supplied toner can be greater. As a result, the range in which the supplied toner is pushed into the developer can be limited to the range where the amount of supplied toner floating on the surface of the developer is greater. In other regions (in the developer conveyance direction Y 1, downstream from the position indicated by line B-B in FIG. 1A), the developer in which virgin toner is mixed can entirely flow into the supply channel 3.

Figure 11:
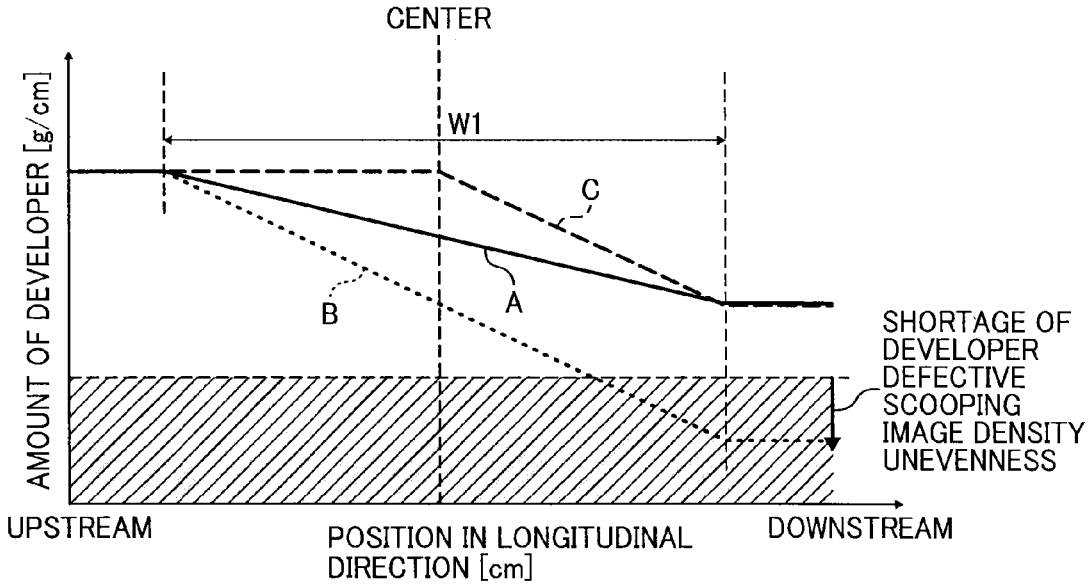
FIG. 11 is a graph illustrating the balance of developer in a direction in which developer is transported.

Referring to FIG. 11, the balance of developer is described below. FIG. 11 is a graph of the amount of developer per unit area in the longitudinal direction of the supply channel 3.

In FIG. 11, the abscissa represents the position (or distance) in the longitudinal direction of the supply channel 3, the ordinate represents the amount of developer per unit area in the developer conveyance direction, and reference character W1 represents the range in which developer is scooped up to the developer bearer 2.

In an area indicated by hatching in FIG. 11, the amount of developer is smaller, and image density unevenness due to unevenness in the amount of developer scooped is occurs.

In FIG. 11, dotted line B represents the developer balance in a comparative configuration in which the entire range along the long side of the partition 8 has the cross-sectional configuration shown in FIG. 1C (cross section of FIG. 1A), that is, the collected-developer guide 100 extends entirely in the developer conveyance direction.

Solid line A in FIG. 11 represents the developer balance in a configuration (hereinafter "embodiment 1" for ease of understanding) employing the feature shown in FIG. 3 to return a part of the collected developer to the supply channel 3 although the collected-developer guide 100 extends entirely along the long side of the partition 8.

Further, broken lines C represent the developer balance in the configuration that adopts the configuration shown in FIGS. 1A to 2B and 5A to 10 (hereinafter "embodiment 2" for ease of understanding). That is, the collected-developer guide 100 extends only in a range upstream from the longitudinal center portion (indicated by line B-B in FIG. 1A) of the second conveyance channel 4 in the developer conveyance direction Y1.

In the comparative configuration (represented by dotted line B in FIG. 11) in which the collected-developer guide 100 extends entirely in the developer conveyance direction, the amount of developer in the supply channel 3 decreases downstream in the developer conveyance direction, and it is possible that the amount of developer decreases abruptly, resulting in the shortage of developer as indicated by dotted line.

That is caused since the collected developer moves to the agitation channel 4 sequentially from the upstream side to the downstream side in the developer conveyance direction.

By contrast, in the embodiment 1 (represented by line A in FIG. 11) in which a part of the collected developer is returned from the collected-developer guide 100 to the supply channel 3, the amount of developer in the supply channel 3 decreases not abruptly but slowly. Since excessive decreases in the amount of developer in the supply channel 3 can be thus inhibited, a sufficient amount of developer can be secured entirely in the developer conveyance direction.

Additionally, embodiment 2, in which the collected-developer guide extends only in a range upstream from the longitudinal center portion of the agitation channel 4, shortage of developer on the upstream side inside the supply channel 3 can be inhibited as indicated by broken line C in FIG. 11. In embodiment 2, since the collected-developer guide 100 does not present in the range upstream from the longitudinal center portion inside supply channel 3, developer falling from the developer bearer 2 can be substantially collected in the supply channel 3.

In the range downstream from the longitudinal center portion of the supply channel 3, the collected-developer guide 100 inhibits the collected developer from falling to the supply channel 3. As a result, although the amount of developer decreases as indicated by broken line C, the degree of decrease is milder. Thus, insufficiency in the amount of scooped developer and unevenness in image density caused by shortage of developer can be inhibited.

To prevent the shortage of developer, the velocity of rotation of the conveying screw may be increased, thereby enhancing the developer conveyance capability.

This approach, however, can increase the stress on developer and accordingly cause separation of an external additive or the like from toner, resulting in changes in charging characteristic, and degradation of developer, resulting in image failure such as image density unevenness. Additionally, it is possible that the friction among developer particles increases, and temperature rises, causing the coagulation of toner.

To address such inconveniences, the present embodiment is configured to inhibit the increase in stress on the mechanism, developer, or both and enhance the efficiency in agitation of carrier and supplied toner, thereby inhibiting the occurrence of defective charge of toner and insufficient image density.

Insufficiently charged toner is likely to scatter, resulting in the background smear, contamination of adjacent areas, or both. Therefore, in the present embodiment, a filter 20 is provided in the agitation channel 4 to inhibit the toner scattering.

As shown in FIG. 1A, the filter 20 is disposed on the upper side of the agitation channel 4 and configured to collect toner and allow the passage of air. Additionally, the filter 20 is positioned downstream from the collected-developer guide 100 in the developer conveyance direction.

The filter 20 can attain the following effects.

In typical developing devices, sucking-in airflow is generated by adjusting the gap between the developer bearer and the casing of the developing device to prevent toner from being discharged. However, it is possible that the internal pressure rises to a degree at which toner can scatter easily if the sucking-in airflow is excessively strong.

Although providing a filter can inhibit such an internal pressure rise, the filter can be clogged with toner over time, thus degrading the filtering capability, if the degree of toner scattering is heavy. In such a case, the internal pressure rise is not prevented sufficiently, allowing toner to scatter.

Therefore, in the present embodiment, the filter 20 is disposed on the upper side at the position downstream from the collected-developer guide 100. The filter 20 is thus disposed at a position where the supplied toner is mixed in developer sufficiently by the collected developer and the amount of scattering toner is reduced. Accordingly, the filter clogging can be inhibited, and the scattering of toner can be inhibited reliably for a long time.

Figure 12:
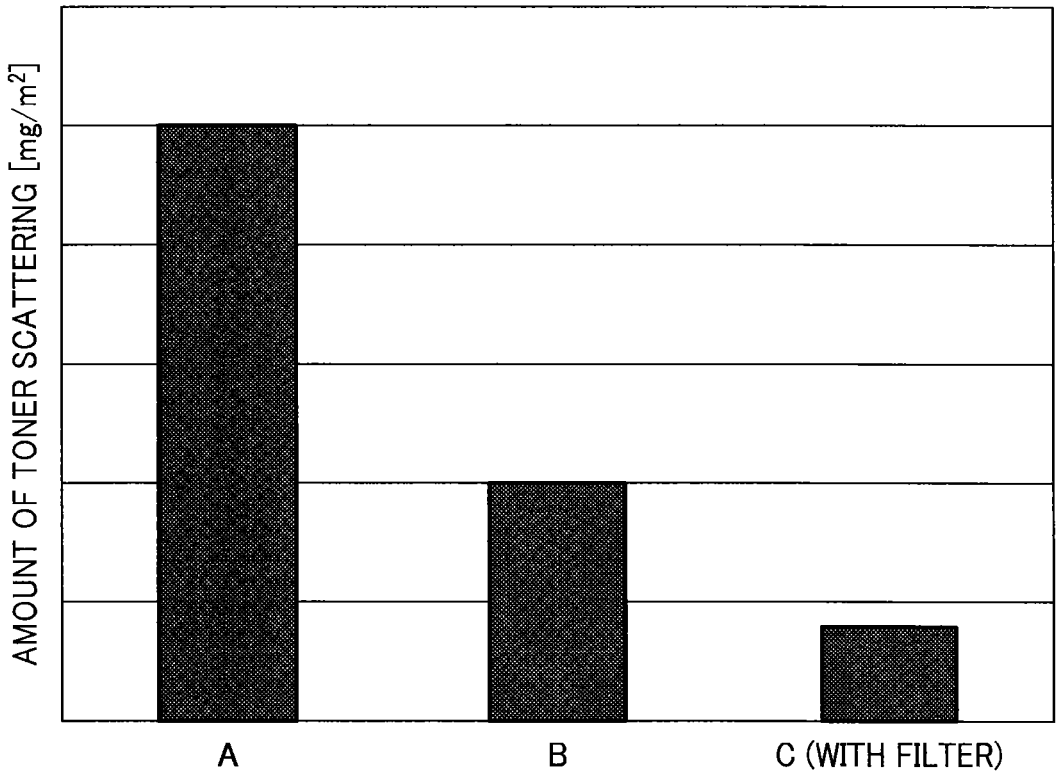
FIG. 12 is a graph illustrating experimentally obtained effects of the developing device according to an embodiment to inhibit toner scattering.

FIG. 12 is a graph illustrating experimentally obtained effects of the filter to inhibit toner scattering.

As an accelerated test, images were output for ten hours under conditions to induce toner scattering (images of high image area ratio were consecutively developed with developer in which the concentration of toner is high). The amount of toner scattering in the test is shown in FIG. 12.

FIG. 12 illustrates the amount of toner scattering in the following three configurations: a conventional developing device provided with a filter (represented by bar A), the configuration in which the collected-developer guide is provided but the filter is not provided (represented by bar B), and the configuration in which both the collected-developer guide and the filter are provided (represented by bar C).

As can be known from the results shown in FIG. 12, the amount of toner scattering can be reduced in the configuration according to the embodiments of the present invention even if the filter is not provided. Further, in the configuration including the filter, the reduction in the amount of toner scattering is significant.

Next, descriptions are given below of an image forming apparatus to which the developing device according to one of the above-described embodiments is applicable.

Figure 13:
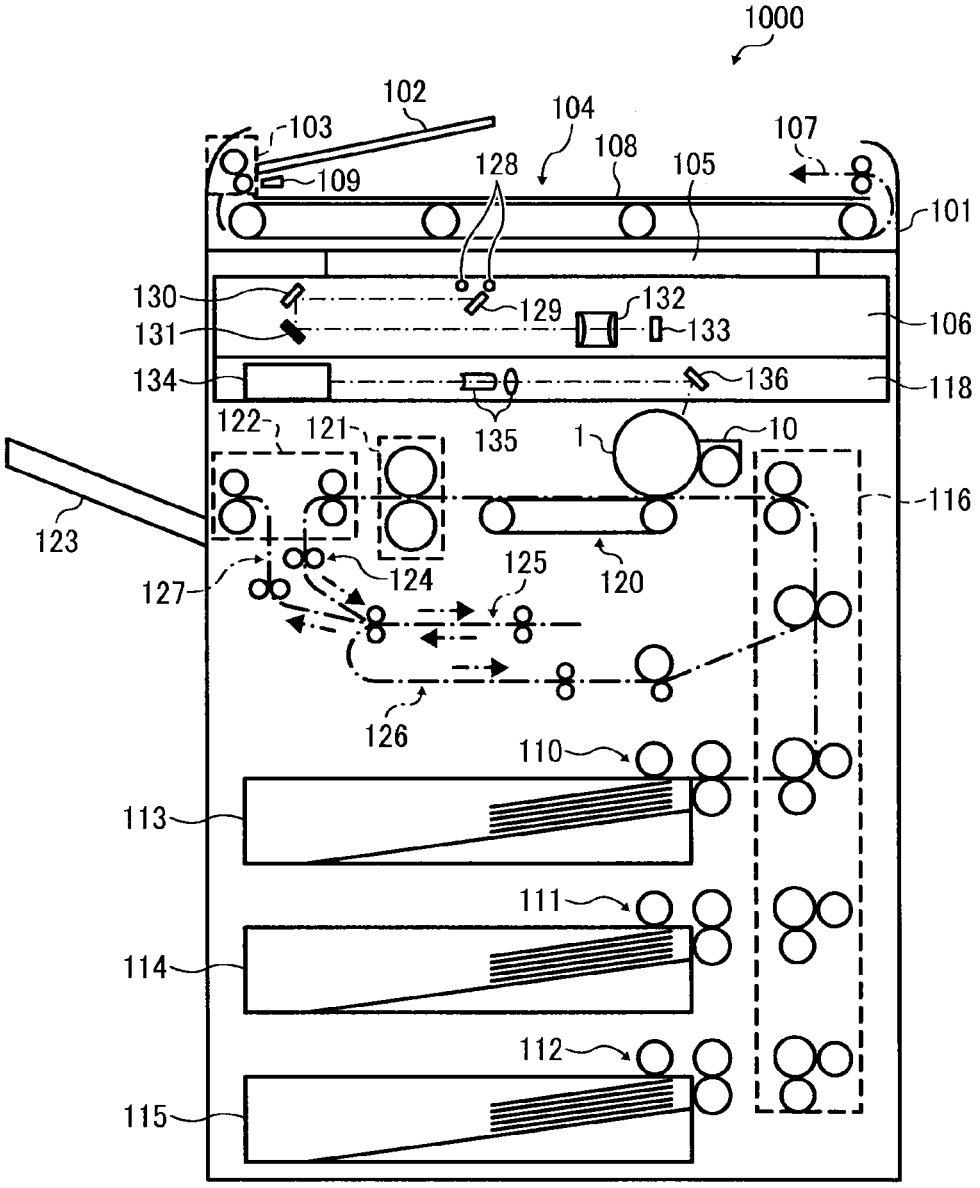
FIG. 13 is a schematic view of an image forming apparatus incorporating a developing device according to an embodiment.

FIG. 13 is a schematic front view of an image forming apparatus 1000, and copying operation thereby is described referring to FIG. 13.

A bundle of originals is placed on a document table 102 of an automatic document feeder (ADF) 101 with image surfaces of the originals facing up. When a start key on a control unit is pressed, the original on the top is transported to a predetermined position on an exposure glass 105 by a feed roller 103 and a conveyance belt 104.

After an image reading device 106 reads image data of the original on the exposure glass 105, the original is discharged to a discharge table 108 by the conveyance belt 104 and a pair of discharge rollers 107. When a document sensor 109 detects the presence of the subsequent original on the document table 102, the original is transported to the exposure glass 105 similarly.

The image reading device 106 scans the original on the exposure glass 105 in a sub-scanning direction while lighting the original with two lamps 128. The light reflected on the original is used as image data and reflected by first, second, and third mirrors 129, 130, and 131 in a predetermined direction. The image data is transmitted to a charge-coupled device (CCD) 133 via a lens unit 132 for reducing and imaging the image data.

The image data read by the image reading device 106 is then transmitted to a writing device 118 via an image processor. The writing device 118 includes a laser light device 134, an f-θ lens 135, reflecting mirrors 136, and the like. Using the image data, the writing device 118 forms an electrostatic latent image according to the original on a photoreceptor drum 1.

Inside the image forming apparatus 1000, the photoreceptor drum 1, the developing device 10, a fixing device 121, a discharge unit 122, first, second, and third sheet feeders 110, 111, and 112, a vertical conveyance unit 116, and the like are provided.

After a charging device uniformly charges the photoreceptor drum 1, the photoreceptor drum 1 is exposed to the light emitted from the writing device 118, thus forming the electrostatic latent image. Then, the developing device 10 develops the electrostatic latent image into a toner image.

Beneath the photoreceptor drum 1, a conveyance belt 120 is disposed.

The conveyance belt 120 has capabilities to transport sheets of recording media and to transfer images. A power source applies a transfer bias to the conveyance belt 120, and the conveyance belt 120 transfers the toner image from the photoreceptor drum 1 onto the sheet while transporting the sheet fed by the vertical conveyance unit 116 at a velocity identical to that of the photoreceptor drum 1.

The toner image is then fixed on the sheet by the fixing device 121, after which the sheet is discharged to a discharge tray 123 via the discharge unit 122. After the toner image is transferred therefrom, the photoreceptor drum 1 is cleaned by a cleaning unit and prepared for subsequent image formation.

The discharge unit 122 includes a reversal unit 125, to which the sheet is sent by a pair of conveyance rollers 124, and a conveyance channel 126 through which the sheet reversed by the reversal unit 125 is again transported to the vertical conveyance unit 116. The discharge unit 122 further includes a duplex conveyance channel that includes a discharge channel 127 through which the reversed sheet is returned to the discharge unit 122.

Using the duplex conveyance channel, images can be formed on both sides of the sheet, and the sheet can be discharged with the image face facing down.

The first, second, and third sheet feeders 110, 111, and 112 include first, second, and third trays 113,114, and 115, respectively. When selected, each of the first, second, and third sheet feeders 110, 111, and 112 feeds sheets from the corresponding tray to the vertical conveyance unit 116. The vertical conveyance unit 116 transports the sheet to a position in contact with the photoreceptor drum 1.

When the image forming apparatus 1000 performs printing, image data transmitted from an external device, instead of the image processor, is input to the writing device 118, according to which an image is formed on a sheet.

At the time of facsimile transmission, a facsimile transceiver transmits image data from the image reading device 106 to a receiver. Further, the image data from the other end of the line is received by the facsimile transceiver and input to the writing device 118, instead of the image data transmitted from the image processor. Then, an image is formed on the sheet.

It is to be noted that, although the description above concerns a multifunction image forming apparatus, image forming apparatuses to which the above-described aspects of the present specification can adapt are not limited thereto and can include copiers, printers, facsimile machines, and plotters, for example.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device to develop with two-component developer an electrostatic latent image formed on a latent image bearer, the developing device comprising:

a developer bearer to carry thereon developer supplied to the latent image bearer;

a first conveyance channel disposed adjacent to the developer bearer, the first conveyance channel from which developer is supplied to the developer bearer;

a second conveyance channel disposed adjacent to the first conveyance channel and farther from the developer bearer than the first conveyance channel, the second conveyance channel through which developer transported from the first conveyance channel is agitated and circulated to the first conveyance channel;

a first conveying member disposed in the first conveyance channel to agitate and transport developer by rotation;

a second conveying member disposed in the second conveyance channel to agitate and transport developer by rotation in a predetermined developer conveyance direction, the second conveying member including a spiral blade winding around a shaft; and a collected-developer guide to guide a part of developer that leaves the developer bearer to the second conveyance channel beyond the first conveyance channel, the collected-developer guide extending partially along a length of a partition dividing the first conveyance channel and the second conveyance channel.

2. The developing device according to claim 1, wherein the collected-developer guide extends partly in the second conveyance channel in the predetermined developer conveyance direction, and an area where the collected-developer guide is present is closer to a toner supply inlet through which virgin toner is introduced into the developing device than an area where the collected-developer guide is not present in the second conveyance channel in the predetermined developer conveyance direction.

3. The developing device according to claim 1, wherein the collected-developer guide extends partly in the second conveyance channel in the predetermined developer conveyance direction, and an area where the collected-developer guide is present is upstream from an area where the collected-developer guide is not present in the second conveyance channel in the predetermined developer conveyance direction.

4. The developing device according to claim 1, wherein the collected-developer guide guides the part of developer downward to a predetermined region in the second conveyance channel, and the predetermined region is positioned on one side of the shaft of the second conveying member in a horizontal direction, the side where the spiral blade of the second conveying member rotates downward.

5. The developing device according to claim 4, wherein the collected-developer guide comprises an inclined plate having an inclination greater than an angle of repose of developer relative to a horizontal direction, and an end of the inclined plate is oriented to the predetermined region.

6. The developing device according to claim 1, wherein the collected-developer guide comprises:

an inclined plate having an inclination relative to a horizontal direction on a cross section perpendicular to the predetermined developer conveyance; and multiple projections projecting from an upper face of the first inclined plate to reduce movement of developer on the inclined plate.

7. The developing device according to claim 1, wherein the collected-developer guide comprises multiple inclined plates inclined relative to a horizontal direction, and a first end of the inclined plate closer to the second conveying member is downstream in the predetermined developer conveyance direction from a second end of the inclined plate away from the second conveying member.

8. The developing device according to claim 7, wherein the inclined plate of the collected-developer guide has an inclination $\phi$ relative to a horizontal direction on a cross section including the predetermined developer conveyance direction and a direction of gravity.

9. The developing device according to claim 8, wherein the inclination $\phi$ is within a range from 45° to 90°.

10. The developing device according to claim 1, further comprising a toner concentration detector disposed in the second conveyance channel to detect a concentration of toner in developer, wherein the collected-developer guide is disposed upstream from the toner concentration detector in the predetermined developer conveyance direction.

11. The developing device according to claim 1, wherein the second conveying member further comprises a paddle disposed at a position to which developer is guided by the collected-developer guide.

12. The developing device according to claim 1, wherein at least one opening is formed in the collected-developer guide to cause developer to move to the first conveyance channel.

13. The developing device according to claim 1, wherein the collected-developer guide has:

an inclination $\theta$ relative to a horizontal direction on a cross section perpendicular to the predetermined developer conveyance direction; and an inclination $\phi$ relative to a horizontal direction on a cross section including the predetermined developer conveyance direction and a direction of gravity, wherein the inclination $\theta$ is greater than an angle of repose of developer to guide developer to the predetermined region.

14. The developing device according to claim 1, wherein a toner supply inlet to introduce virgin toner is formed in the second conveyance channel, the toner supply inlet disposed on an upstream side in the predetermined developer conveyance direction.

15. The developing device according to claim 14, wherein the toner supply inlet is disposed above the collected-developer guide.

16. The developing device according to claim 1, wherein the collected-developer guide comprises a vibration plate having an inclination relative to a horizontal direction on a cross section perpendicular to the predetermined developer conveyance direction.

17. The developing device according to claim 1, wherein the second conveyance channel is divided by the partition, at least partly, from the first conveyance channel, and the collected-developer guide is provided to an upper end of the partition.

18. The developing device according to claim 1, further comprising a filter provided on an upper face of the second conveyance channel to block developer, wherein the filter is disposed downstream from the collected-developer guide in the predetermined developer conveyance direction.

19. An image forming apparatus comprising:

the latent image bearer; and the developing device according to claim 1.

20. A developing device to develop with two-component developer an electrostatic latent image formed on a latent image bearer, the developing device comprising:

a developer bearer to carry thereon developer supplied to the latent image bearer;

first and second conveyance channels disposed adjacent to each other, the first conveyance channel from which developer is supplied to the developer bearer;

the second conveyance channel through which developer transported from the first conveyance channel is circulated to the first conveyance channel;

a first conveying member disposed in the first conveyance channel to agitate and transport developer by rotation;

a second conveying member disposed in the second conveyance channel to agitate and transport developer by rotation in a predetermined developer conveyance direction, the second conveying member including a spiral blade winding around a shaft; and a collected-developer guide to guide a part of developer that leaves the developer bearer downward to a predetermined region in the second conveyance channel with reference to the shaft of the second conveying member, the predetermined region where movement of developer by the rotation of the second conveying member is small, the collected-developer guide extending partially along a length of a partition dividing the first conveyance channel and the second conveyance channel.

* * * * *